US005718351A

United States Patent [19]

Rude

[11] Patent Number: 5,718,351

[45] Date of Patent: Feb. 17, 1998

[54] FLAT BOTTOM TANK

[75] Inventor: Arthur D. Rude, Ash Grove, Mo.

[73] Assignee: Custom Metalcraft, Inc., Springfield, Mo.

[21] Appl. No.: 614,269

[22] Filed: Mar. 12, 1996

[51] Int. Cl.[6] ..... B65D 81/36

[52] U.S. Cl. ..... 220/571

[58] Field of Search ..... 220/571

[56] References Cited

U.S. PATENT DOCUMENTS

| | | | |
|---|---|---|---|
| 1,576,319 | 3/1926 | Fagley | 220/571 |
| 1,584,175 | 5/1926 | Irons | 220/571 |
| 4,150,763 | 4/1979 | Simpson | 220/571 |
| 4,651,887 | 3/1987 | Patrick | 220/571 |
| 4,733,790 | 3/1988 | Stein . | |
| 4,746,034 | 5/1988 | Ata et al. . | |
| 4,767,021 | 8/1988 | Pies . | |
| 4,782,973 | 11/1988 | Wiese . | |
| 5,253,777 | 10/1993 | Schutz . | |
| 5,316,174 | 5/1994 | Schutz . | |
| 5,346,094 | 9/1994 | Strawser . | |

*Primary Examiner*—Joseph M. Moy
*Attorney, Agent, or Firm*—Nies, Kurz, Bergert & Tamburro

[57] ABSTRACT

A flat bottom tank provides for complete drainage of liquid contents through sloped drainage in the bottom head. The bottom head has a raised center portion which is pyramidal shaped in one embodiment. The sides of the bottom head are broken upwardly to form smooth, rounded wall surfaces. The center portion and the side walls slope downwardly towards one another to form a line of flow extending around the perimeter of the center portion. The line of flow slopes downwardly from a first corner of the bottom head to a second corner of the bottom head which is diagonally opposite the first corner. A drain outlet located adjacent the second corner allows for the drainage of liquid contents from the tank.

24 Claims, 3 Drawing Sheets

FLAT BOTTOM TANK

BACKGROUND AND SUMMARY OF THE INVENTION

The present invention is related to portable tanks and more particularly to flat bottom tanks having improved drainage characteristics.

Previous tank bottoms are described in the following U.S. Pat. No. 4,723,790 to Stein; U.S. Pat. No. 4,746,034 to Ata et al. U.S. Pat. No. 4,767,021 to Pies; U.S. Pat. No. 4,782,973 to Wiese; U.S. Pat. No. 5,253,777 to Schutz; U.S. Pat. No. 5,316,174 to Schutz; and U.S. Pat. No. 5,346,094 to Strawser.

By the present invention, there is provided a flat bottom tank with a top head and side walls and a generally square or rectangular shaped bottom head having four sides and a plurality of planar surfaces formed in a pyramidal shape which extend from the center of the bottom head downwardly towards the sides. The extremities of the sides of the bottom head are broken upwardly to form a plurality of smooth, rounded wall surfaces which merge with the side walls of the tank. The bottom head extends downwardly from the sides to intersect the planar surfaces sloping downwardly from the center of the bottom head and thereby form a line of flow which, together with the intersecting planar surfaces, defines a canal for directing the flow of liquids. The line of flow extends circumferentially around the interior of the tank bottom. The line of flow has a high point located near one corner of the tank bottom and a low point located near the corner diagonally opposite from the high point corner. A drainage outlet is formed near the low point of the line of flow for final drainage of the tank contents. The tank construction of the present invention provides for substantially complete drainage of fluid from the tank.

DESCRIPTION OF THE PREFERRED EMBODIMENTS

Figure 1:
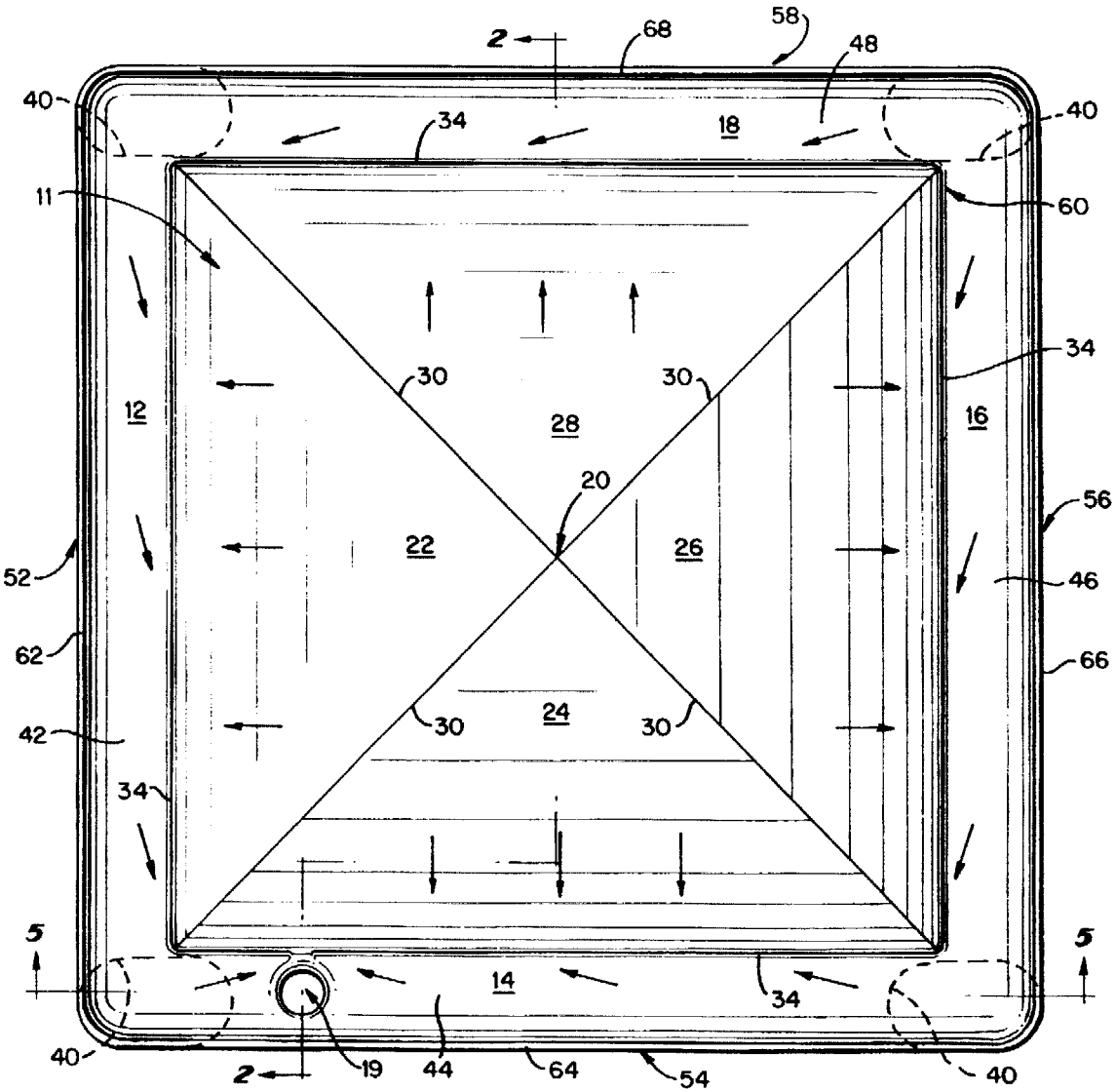
FIG. 1 is a top plan view of the tank bottom of the present invention, with arrows showing the direction of content drainage.
Figure 2:
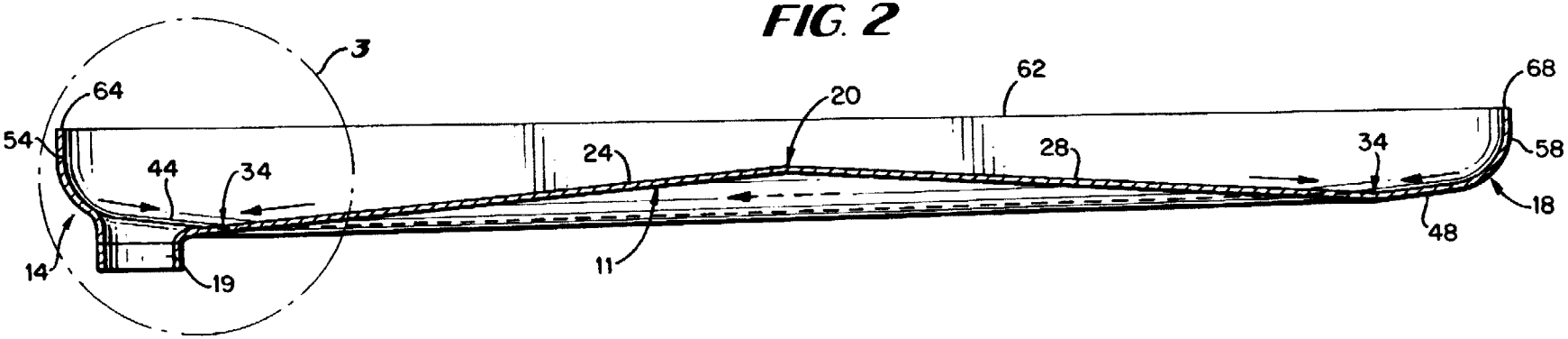
FIG. 2 is a cross-sectional view of the tank bottom taken along line 2—2 of FIG. 1.
Figure 3:
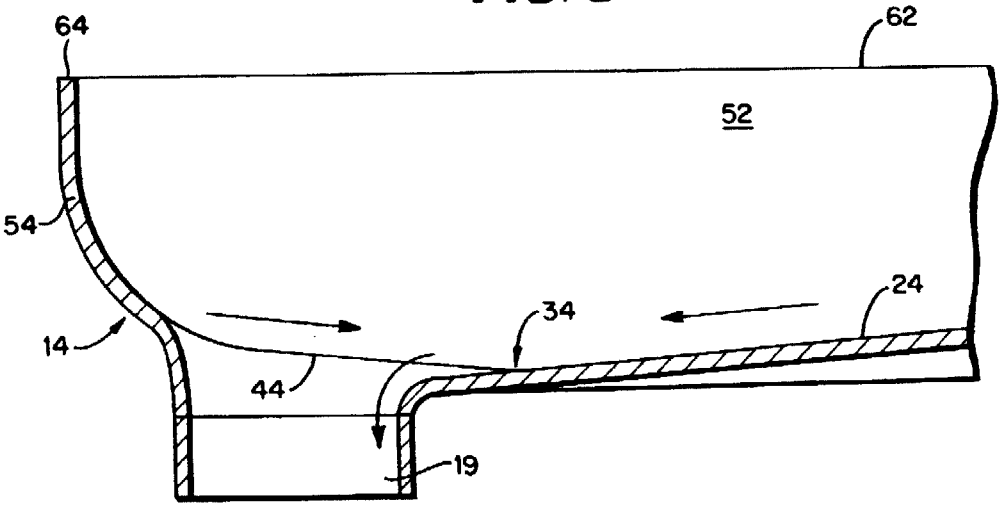
FIG. 3 is an enlarged detail view of the drain portion of FIG. 2.
Figure 4:
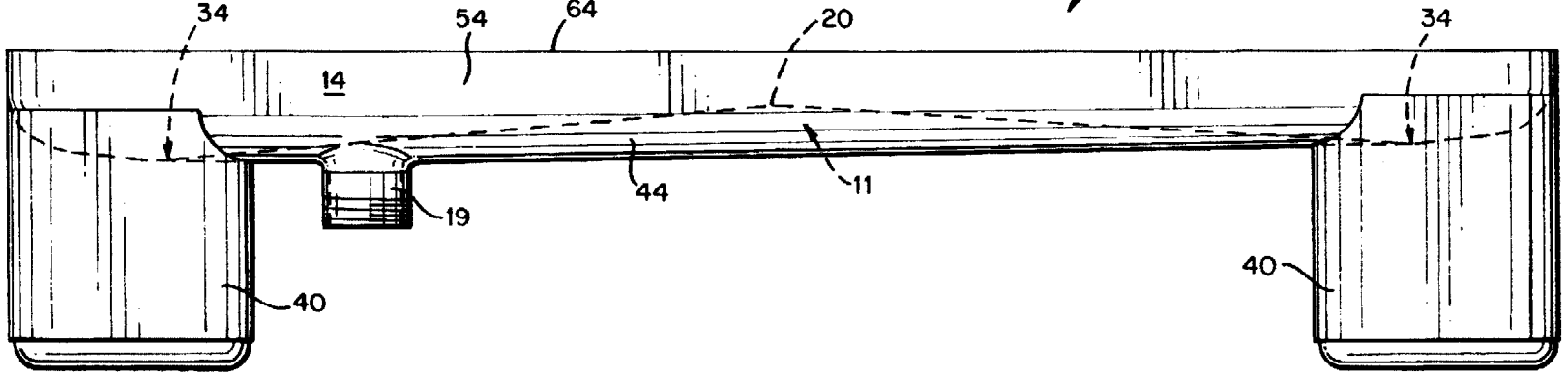
FIG. 4 is a front elevation view of the tank bottom of the present invention.
Figure 5:
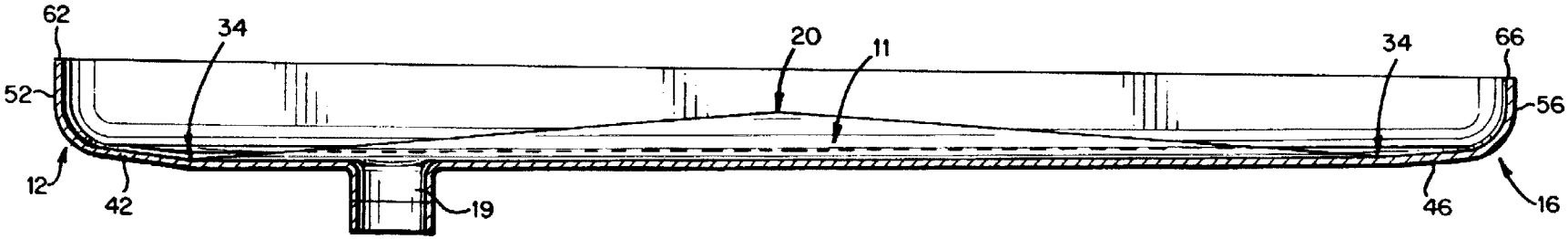
FIG. 5 is a cross-sectional view of the tank bottom taken along line 5—5 of FIG. 1.

In the embodiment of the invention as shown in FIGS. 1 through 5, there is provided a tank bottom 10 having a central head portion 11, planar outer head portions 12, 14, 16, 18, and a drain outlet 19. The central portion 11 is of pyramidal shape having four triangular shaped planar members 22, 24, 26, 28 which extend downwardly from a central point or vertex 20 to a line of flow 34 formed by the intersection of central planar members 22, 24, 26 and 28 with respective outer head portions 12, 14, 16 and 18. The line of flow 34 extends around the perimeter of the central portion 11. The creases 30 formed by the respective intersections of planar members 22, 24, 26, 28 extend from the central vertex 20 to the line of flow 34. The line of flow 34 thus is basically the intersection of two smoothly contoured planar surfaces defining a canal which extends around the periphery of the tank bottom, with no cut channel or indentation which would interfere with the flow of liquids. This feature is of particular importance when employing viscous liquids having a tendency to adhere to side wall surfaces. In one embodiment, the creases 30 extend to within 4 inches of the sides of the tank.

The tank bottom 10 of the present invention may be flat stamped or swedged in accordance with procedures known in the art. Thus the bottom head can be made in different sizes as required by stamping or swedging of material in a press with dies.

The tank bottom 10 is supported by legs 40 which, in one embodiment of the invention, are of equal height. This is an advantage over prior art tank bottoms which employ one or more legs of a size taller or shorter than the other legs to compensate for a sloped bottom. Such prior art tanks are often misbalanced causing the tank to rock undesirably.

Each outer head portion 12, 14, 16, 18 is broken upwards at its outer edge so as to have a curved shape which includes a respective planar bottom wall portion 42, 44, 46, 48 and a respective upturned vertical portion 52, 54, 56, 58 which terminates in a respective side wall edge 62, 64, 66, 68. The edges 62, 64, 66, 68 are formed to merge with the side walls of the tank. In one embodiment of the invention, the curved shape of each outer head portion 12, 14, 16, 18 is formed with a two inch radius break. The planar bottom wall portions 42, 44, 46, 48 slope downwardly from the upturned vertical portions 52, 54, 56, 58 towards the line of flow 34 so as to direct the contents of the tank towards the drainage outlet 19. The side wall edges 62, 64, 66, 68 are of substantially the same height so as to allow smooth attachment of a tank shell to the tank bottom.

The curved shape of the side wall portions of the tank bottom 10 provides smooth, rounded corners and sides for optimal draining. These rounded corners offer an advantage over previous devices having interior creases or squared edges which are difficult to clean. This feature of the present invention is especially important for containers in the food and pharmaceutical industries as it promotes clean interior surfaces and allows complete drainage of liquid from the tank.

The line of flow 34 is formed by the intersection of the central head portion 11 and the outer head portions 12, 14, 16, 18 and slopes downwardly from a high point at corner 60 to the outlet 19. In a preferred embodiment of the invention, as shown in FIGS. 2 through 5, the line of flow 34 is not indented or provided with a depth greater than the depth formed by the intersection of the central and outer head portions. This prevents the liquid product from collecting along the line of flow 34 while still allowing the product to flow during drainage. The line of flow 34 slopes downwardly from the corner point 60 around to the outlet 19 in both a clockwise and a counterclockwise direction to enable fluid being drained from the tank to travel along either route to the outlet 19. This configuration helps prevent congestion along any particular route to the outlet. In one embodiment of the invention, the line of flow 34 is approximately ⅜ inch lower at the outlet 19 than it is at corner point 60.

The outlet 19 is formed with a cylindrical shape and is the same depth as the line of flow 34 at the drainage point. The outlet 19 is located near the corner which is diagonally opposite corner point 60 and in one embodiment is approximately two inches in diameter. The outlet 19 also is positioned exclusively within outer head portion 14, as shown in FIG. 1, and does not extend into the line of flow 34 or the central head portion 11. In one embodiment of the invention, the outlet 19 is positioned so that its closest edge to the line of flow 34 is located approximately one inch away from the line of flow 34.

The configuration of the tank bottom central head portion 11 and outer head portions 12, 14, 16, 18 provides for complete drainage of the liquid contents within the tank. The pyramidal shape of the central portion 11 and the curved shape of the side wall portions directs fluid towards the line of flow 34 in all directions. The line of flow 34 then allows the fluid to pass along its downward slope until it reaches the outlet 19. The outlet 19 is swedged downwardly in a smooth contour such that liquid material within the tank will flow downwardly from the point of the line of flow 34 nearest the outlet 19 into the outlet 19 itself.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A method of forming the bottom of a tank for liquids, said tank having generally upwardly extending sides, comprising the steps of:

a) providing a square or rectangular shaped bottom plate member having a plurality of sides and corner portions;

b) forming said bottom plate to provide a raised center portion which slopes downwardly towards said sides;

c) breaking each of said sides upwardly to form side wall portions having substantially vertical upwardly extending wall portions, said side wall portions also having sloped bottom wall portions which slope downwardly from said vertical upwardly extending wall portions to meet said center portion of the tank bottom and thereby form a line of flow, said line of flow extending around the perimeter of said center portion and having a downward slope extending from a first one of said corner portions to a second one of said corner portions, said second corner being located diagonally opposite said first corner; and d) forming a drain outlet in the bottom wall portion of one of the side wall portions adjacent said second corner.

2. The method of claim 1 wherein said center portion is formed in a pyramidal shape with four triangular shaped planar surfaces each extending from a center point or vertex downwardly towards a respective one of said side wall portions and intersecting said side wall portions at said line of flow.

3. The method of claim 1 wherein said side wall portions are formed so as to be rounded where the vertical wall portions meet the sloped bottom wall portions.

4. The method of claim 1 wherein said corner portions are formed so as to be rounded where adjacent pairs of side wall portions meet.

5. The method of claim 1 wherein said side wall portions are formed to be of substantially equal height such that a tank shell may be easily fitted to the tank bottom.

6. The method of claim 1 wherein said drain outlet is formed so as to be cylindrical in shape.

7. The method of claim 1 wherein said drain outlet is spaced apart from said line of flow.

8. The method of claim 7 wherein said drain outlet is located at a distance of approximately one inch from said line of flow.

9. The method of claim 1 wherein said drain outlet is swedged downward such that said bottom wall portion containing said drain outlet slopes downwardly towards said drain outlet from the point in said line of flow nearest said drain outlet.

10. The method of claim 1 wherein said center portion and said side wall portions are formed to meet at said line of flow such that said line of flow is substantially square or rectangular in shape and slopes downwardly from said first corner in both a clockwise and a counterclockwise direction extending around the perimeter of said center portion.

11. The method of claim 1 which further includes mounting a support leg on each corner portion, said support legs being of equal length.

12. The method of claim 11 wherein said tank has four corner portions with four support legs of equal length mounted thereon.

13. A portable tank for liquids, said tank having generally upwardly extending sides and a bottom head which provides for complete drainage of liquid from the tank, wherein said bottom head comprises a one-piece construction formed from a square or rectangular shaped bottom plate member having a plurality of sides and corner portions, said plate member having a raised center portion which slopes downwardly towards said sides; the sides of the plate member being broken upwardly to form side wall portions having substantially vertical upwardly extending wall portions, said side wall portions also having sloped bottom wall portions which slope downwardly from the vertical upwardly extending wall portions to meet the center portion of the tank bottom and thereby form a line of flow, said line of flow extending around the perimeter of the center portion and having a downward slope extending from a first one of the corner portions to a second one of the corner portions, said second corner being located diagonally opposite said first corner; and with a drain outlet formed in the bottom wall portion of one of the side wall portions adjacent said second corner.

14. The tank of claim 13 wherein said center portion is formed in a pyramidal shape with four triangular shaped planar surfaces each extending from a center point or vertex downwardly towards a respective one of said side wall portions and intersecting said side wall portions at said line of flow.

15. The tank of claim 13 wherein said side wall portions are formed so as to be rounded where the vertical wall portions meet the sloped bottom wall portions.

16. The tank of claim 13 wherein said corner portions are formed so as to be rounded where adjacent pairs of side wall portions meet.

17. The tank of claim 13 wherein said side wall portions are formed to be of substantially equal height such that a tank shell may be easily fitted to the tank bottom.

18. The tank of claim 13 wherein said drain outlet is formed so as to be cylindrical in shape.

19. The tank of claim 13 wherein said drain outlet is spaced apart from said line of flow.

20. The tank of claim 19 wherein said drain outlet is located at a distance of approximately one inch from said line of flow.

21. The tank of claim 13 wherein said drain outlet is swedged downward such that said bottom wall portion containing said drain outlet slopes downwardly towards said drain outlet from the point in said line of flow nearest said drain outlet.

22. The tank of claim 13 wherein said center portion and said side wall portions are formed to meet at said line of flow such that said line of flow is substantially square or rectangular in shape and slopes downwardly from said first corner in both a clockwise and a counterclockwise direction extending around the perimeter of said center portion.

23. The tank of claim 13 wherein a support leg is mounted on each corner portion, said support legs being of equal length.

24. The tank of claim 23 wherein said tank has four corner portions with four support legs of equal length mounted thereon.

* * * * *